US008192052B2

(12) United States Patent
Jacobson et al.

(10) Patent No.: US 8,192,052 B2
(45) Date of Patent: Jun. 5, 2012

(54) LAMP AND METHOD FOR SUPPORTING A LIGHT SOURCE

(75) Inventors: A. Brian Jacobson, Milford, MA (US); B. Mayur Pangrekar, Waltham, MA (US)

(73) Assignee: Sunnex, Inc., Natick, MA (US)

( * ) Notice: Subject to any disclaimer, the term of this patent is extended or adjusted under 35 U.S.C. 154(b) by 848 days.

(21) Appl. No.: 12/244,973

(22) Filed: Oct. 3, 2008

(65) Prior Publication Data

US 2009/0091938 A1 Apr. 9, 2009

Related U.S. Application Data

(60) Provisional application No. 60/977,182, filed on Oct. 3, 2007.

(51) Int. Cl.
*F21V 19/00* (2006.01)

(52) U.S. Cl. ..... 362/288; 362/382; 362/440; 362/444; 362/519; 362/549

(58) Field of Classification Search ..... 362/217.1, 362/217.11–217.17, 220, 382, 418, 427, 362/433, 440, 444, 288, 519, 549
See application file for complete search history.

(56) References Cited

U.S. PATENT DOCUMENTS

2005/0248937 A1* 11/2005 Kain et al. ..... 362/217
* cited by examiner

*Primary Examiner* — Stephen F Husar
*Assistant Examiner* — Meghan Dunwiddie
(74) *Attorney, Agent, or Firm* — Peter A. Nieves; Sheehan Phinney Bass + Green PA

(57) ABSTRACT

A lamp is provided. Generally, the lamp comprises light source means for providing illumination in a frontward direction, retainer means for applying a frontward-directed load to the light source, and housing means for mechanically supporting the light source means and the retainer means.

26 Claims, 7 Drawing Sheets

LAMP AND METHOD FOR SUPPORTING A LIGHT SOURCE

CROSS-REFERENCE TO RELATED APPLICATION

This application claims priority to U.S. Provisional Patent Application entitled "System and Method for Supporting a Light Source," having Ser. No. 60/977,182, filed Oct. 3, 2007, which is hereby incorporated herein in its entirety by reference.

FIELD OF THE INVENTION

The present invention is generally related to a lamp, and more particularly is related to a lamp having a housing assembly employing a spring-loaded retainer to support and direct a light source.

BACKGROUND OF THE INVENTION

Lamps are often assembled by installing a light source in a housing. Examples of such lamps include examination lamps such as those used in dentistry or in hospital emergency rooms for lighting when applying stitches, for example, as well as lamps used in residential applications for spot lighting or lamps used in industrial applications for task lighting. Light sources used in such lamps may include halogen bulbs, light-emitting diode (hereinafter "LED") arrays, and other suitable light bulbs. Such light bulbs are often consumable items that typically need to be replaced from time to time during the life of the lamp.

FIG. 1 is a schematic diagram of a lamp 900 in accordance with a conventional example. FIG. 2 is an exploded view of the lamp 900 shown in FIG. 1, components thereof being shown as disassembled for replacement of the light bulb 905.

Referring to FIGS. 1 and 2, a lamp 900 in accordance with the conventional art comprises a light bulb 905 that is held in place within a housing 910 by means of two V-shaped spring wires (also referred to herein as V-springs) 990. As shown in FIGS. 1 and 2, the housing 910 has an undercut lip 915 that retains the V-springs 990 when the V-springs 990 are in their installed configuration. During replacement of the light bulb 905, these V-springs 990 are flexed by hand so as to clear the undercut lip 915 of the housing 910, removal and reinstallation of the V-springs 990 being necessary when replacing an old light bulb 905 with a new light bulb 905.

In accordance with the conventional art, when replacing a light bulb 905, it is necessary to remove both V-springs 990 prior to removing and replacing the light bulb 905. After removal and replacement of the light bulb 905, the V-springs 990 must be returned to approximately their original configuration within the recess of the undercut lip 915 of the housing. During removal and return of the V-springs 990, attempts to manipulate the V-springs 990 by hand can be painful and imprecise, while use of tools to pry or press the V-springs 990 can result in damage to the undercut lip 915 or other portions of the housing 910, the V-springs 990, and the light bulb 905. Moreover, when attempting to press a V-spring 990 into the recess of the undercut lip 915, sudden buckling or shifting of an end of the V-spring 990 may cause the V-spring 990 to fly off into space. Moreover, a typical user, especially when in a hurry or frustrated by the challenge of simultaneously manipulating the free ends of the V-springs 990 to achieve proper installation without injury to fingers or lamp, may settle for incomplete or improper installation, as there is no positive or definitive mechanism to prevent the user from judging that the lamp is ready for use despite lost, unused, or improperly positioned V-springs 990.

The V-springs 990 of the conventional example shown in FIGS. 1 and 2, even when installed properly, contact the rear surface of the light bulb 905 in point fashion at, at most, a discrete number of locations (four in the example shown in FIG. 1). Furthermore, even where the V-springs 990 are installed properly, the V-springs 990 may provide little in the way of spring loading of the light bulb 905 against the front of the housing 910. Moreover, what little spring loading may exist with V-springs 990 will typically provide inadequate mechanical compliance, meaning that a small change in displacement, due for example to variation in part dimensions or installation technique or due to temperature change or impact, can result in a large change in bulb-retaining force, and may even swamp or overwhelm what compliance may exist, easily resulting in backlash or slop between parts. In this way, any number of unsatisfactory conditions resulting from use of V-springs 990 may result in poor lamp performance or even light source failure due to loose or improper support of the bulb 905.

Thus, a heretofore unaddressed need exists in the industry to address the aforementioned deficiencies and inadequacies.

SUMMARY

Embodiments of the present invention provide a lamp or lamp assembly as well as a method for supporting a light source.

Briefly described, one embodiment, among others, is a lamp comprising a bulb capable of providing illumination in a frontward direction and having a rear surface; a retainer capable of applying a frontward-directed load to the rear surface of the bulb; and a housing capable of mechanically supporting the bulb and the retainer. In some embodiments, the retainer may be pivotably mounted to the housing. In some embodiments, the rear surface of the bulb may have a convex profile, the retainer may have a concave side, and the frontward-directed load may be applied as a result of contact between the concave side of the retainer and the convex profile of the bulb rear surface.

Another embodiment is a lamp assembly comprising a housing having a free end, a stop end, and a channel formed between the free end and the stop end. The channel may be cylindrical. The housing may have a pivot support. The retainer may have a pivot end. In some embodiments, the retainer may be openably installed on the housing so as to be capable of assuming an open configuration and a closed configuration. In some embodiments, the pivot end of the retainer may be pivotably supported by the pivot support of the housing so that the retainer can assume an open and a closed configuration. In some embodiments, the retainer at least partially spans a width direction of the channel when the retainer is in its closed configuration, and the retainer has a concave side that is directed toward the stop end of the housing when the retainer is in its closed configuration. The retainer may swing out of the way of the channel of the housing when the retainer is moved from its closed to its open configuration.

The retainer may have a latch end. The housing may have a latch holder. In some embodiments, the latch end of the retainer may engage with the latch holder of the housing when the retainer is moved from its open to its closed configuration. The latch end may be a tab. The latch holder may be a slot.

The retainer may have a bridge region between the pivot end and the latch end. The bridge region may be curved such that a concave side thereof leads as the retainer is moved from its open to its closed configuration. The concave side of the retainer may be directed toward the stop end of the housing when the retainer is in its closed configuration. An axis of symmetry of the concave side of the retainer may be substantially parallel to an axis of the channel when the retainer is in its closed configuration.

The retainer may have a shoulder region between the bridge region and the latch end. In some embodiments, finger pressure on the shoulder region causes the retainer to flex so as to permit the latch end of the retainer to engage with the latch holder of the housing when the retainer is moved from its open to its closed configuration, and so as to permit the latch end of the retainer to disengage from the latch holder of the housing when the retainer is moved from its closed to its open configuration.

The lamp assembly may further comprise a bulb. In some embodiments, the bulb can be removed from the housing when the retainer is in its open configuration. In some embodiments, the retainer applies a load to the bulb when the retainer is in its closed configuration. The bulb may have a convex rear surface. The concave side of the bridge region of the retainer may contact the convex rear surface of the bulb when the retainer is in its closed configuration. In one embodiment, a load applied from the retainer to the bulb rear surface when the retainer is in its closed configuration is more or less uniformly distributed along the concave side of the curved bridge region. In another embodiment, the concave side of the bridge region of the retainer contacts the convex rear surface of the bulb at the pivot end side of the bridge region, but does not contact the convex rear surface of the bulb at the latch end side of the bridge region, when the retainer is in its closed configuration.

In an embodiment in which the concave side of the bridge region of the retainer contacts the convex rear surface of the bulb at the pivot end side of the bridge region but does not contact the convex rear surface of the bulb at the latch end side of the bridge region when the retainer is in its closed configuration, clearance between the retainer and the bulb rear surface at the latch end side of the bridge region when the retainer is in its closed configuration may be sufficient to prevent the latch end side of the bridge region from hitting the bulb rear surface during disengagement of the latch end of the retainer from the latch holder of the housing when the retainer is being moved from its closed to its open configuration.

Other embodiments, systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

As used herein, the term "light bulb" (also referred to simply as "bulb") refers to any light source capable of being installed in a lamp housing, without limitation with regard to shape except as otherwise specified herein. As used herein, except where otherwise clear from context, the term "lamp" refers to the combination of a housing, a retainer, and a bulb. As used herein, except where otherwise clear from context, the term "lamp assembly" refers to the combination of a housing and a retainer, regardless of whether a bulb is additionally present. As used herein, except where otherwise clear from context, the term "housing assembly" refers to the combination of a housing and a retainer.

The present invention provides a lamp or lamp assembly as well as a method for supporting a light source. For example, one embodiment of the present invention is a lamp such as might be used in dentistry or in a hospital emergency room for lighting when applying stitches or during a medical examination, or such as might be used in a residential application for spot lighting or in an industrial application for task lighting.

Figure 3:
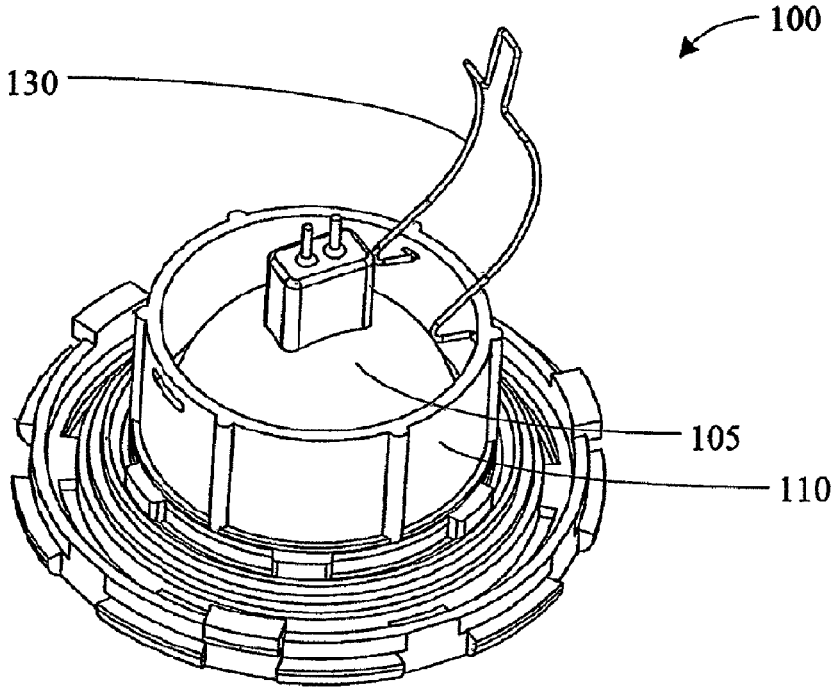
FIG. 3 is a schematic diagram of a lamp employing a halogen light source in accordance with a first embodiment of the present invention, the retainer being shown in a configuration that is partway between its open configuration and its closed configuration.
Figure 4:
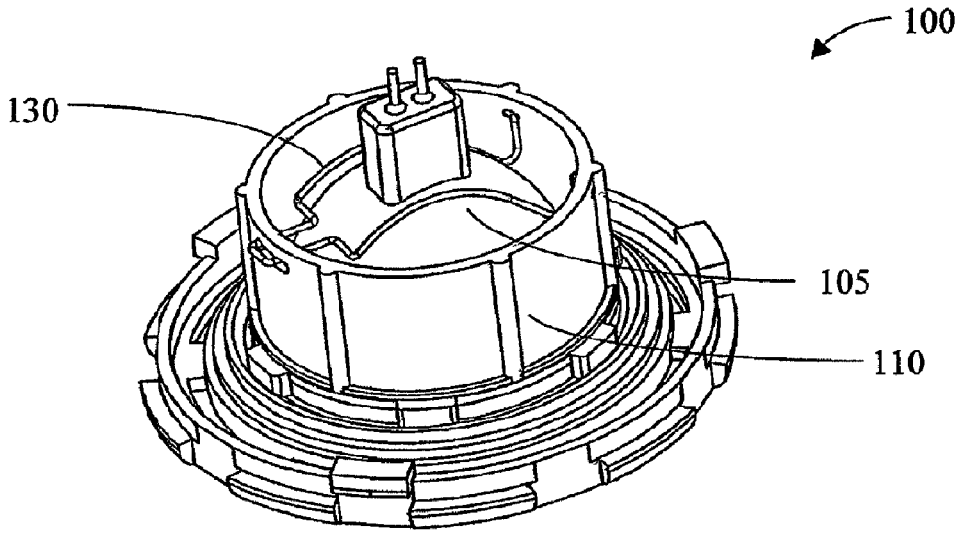
FIG. 4 shows the lamp of FIG. 3, the retainer being shown in its closed configuration.
Figure 5:
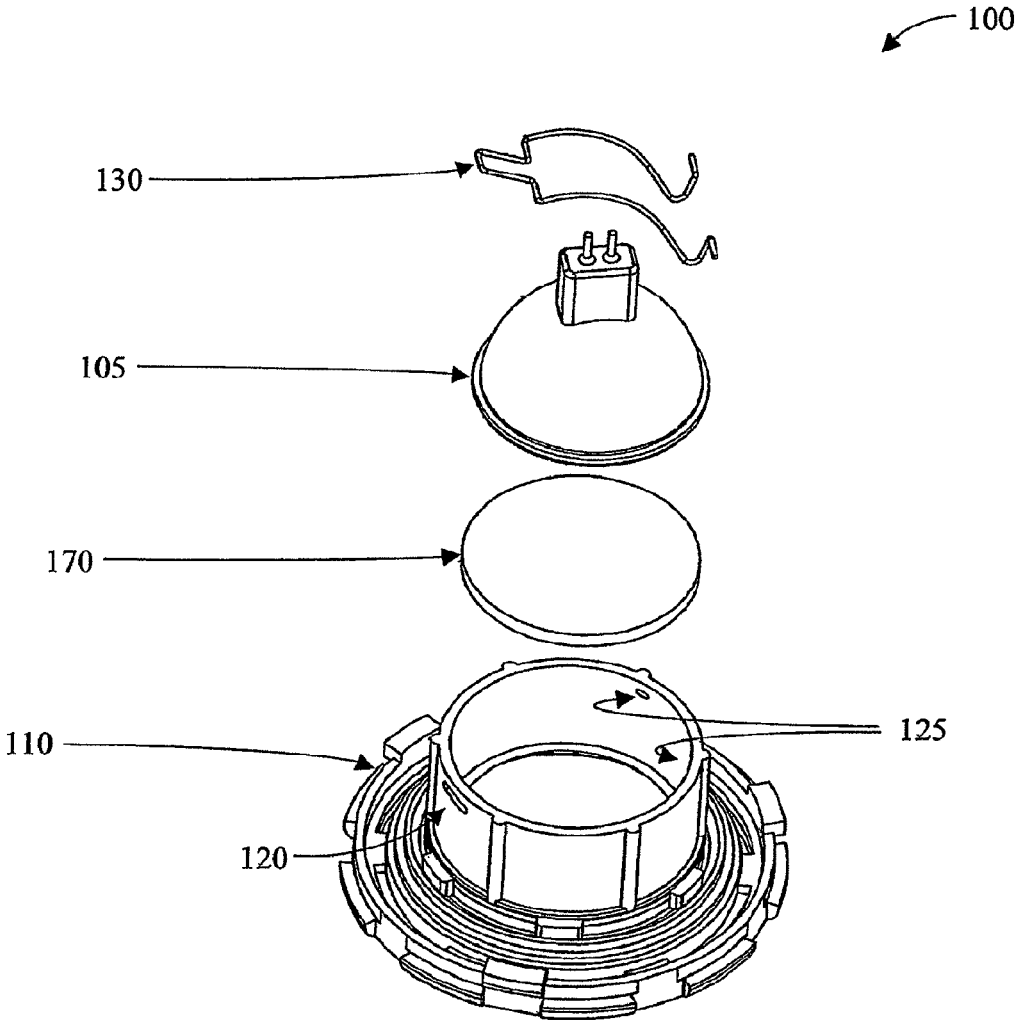
FIG. 5 is an exploded view of the lamp shown in FIGS. 3 and 4.

Referring to FIGS. 3 through 5, these are schematic diagrams of a lamp 100 in accordance with a first embodiment of the present invention. This lamp 100 comprises a halogen light bulb 105 serving as light source installed within a housing assembly consisting of a housing 110 and a retainer 130. Also visible at FIG. 5 is a lens/filter 170. As can be seen at FIGS. 3 and 4, the retainer 130 in the first embodiment is pivotably mounted to the housing 110 so as to be capable of assuming an open and a closed configuration. At FIG. 3, the retainer 130 is shown in a configuration that is partway between its open configuration and its closed configuration. At FIG. 4, the retainer 130 is shown in its closed configuration. At FIG. 5, an exploded view of the lamp 100 is shown.

Taking the front of the housing 110 as the direction from which the light bulb 105 projects illumination when the light bulb 105 is installed in the housing assembly, the light bulb 105 provides illumination in a frontward direction, this frontward direction being in a direction toward the bottom of the drawing in FIGS. 3 through 5. The rear, or back, of the housing 110 is the side of the housing that is opposite to the front of the housing 110, the rearward direction being in a direction toward the top of the drawing in FIGS. 3 through 5. When the light bulb 105 is installed in the housing assembly, the front surface (not shown) of the light bulb 105 is toward the front of the housing 110, and the rear surface of the light bulb 105 is toward the back of the housing 110. The rear surface of the light bulb 105 shown in FIGS. 3 through 5 has a convex profile, this being typical of light bulbs employing reflectors to focus or direct illumination in a frontward direction. Note, however, that the present invention is not limited to light sources having rear surfaces with convex profiles.

Figure 6:
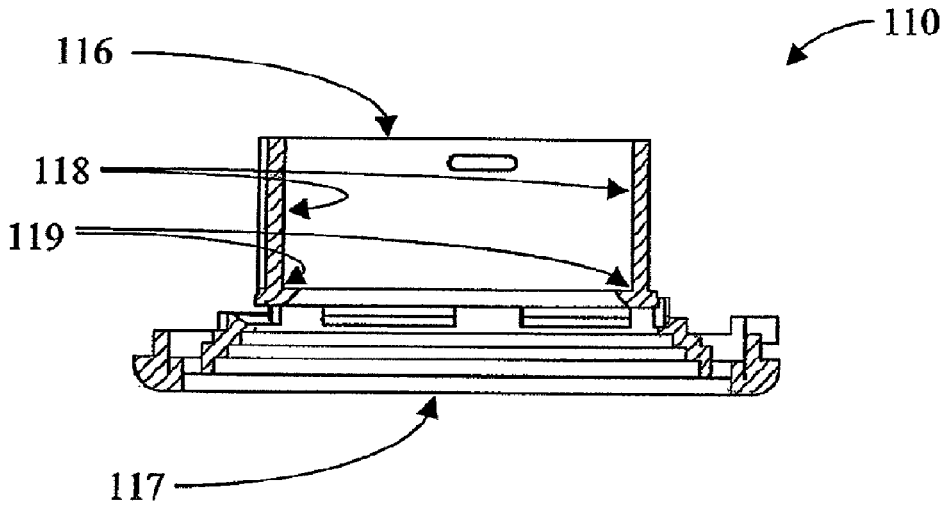
FIG. 6 is a sectional view of the housing of the lamp shown in FIGS. 3 through 5.

Referring to FIG. 6, this is a sectional view of the housing 110 of the lamp 100 shown in FIGS. 3 through 5. As best seen at FIG. 6, the housing 110 has a free end 116 which does not hinder or obstruct passage of the light bulb 105, this free end 116 of the housing 110 permitting the light bulb 105 to be inserted into or removed from the housing 110. In the example shown in FIGS. 3 through 6, the free end 116 of the housing 110 corresponds to the rear of the housing 110, this being the end of the housing 110 that appears toward the top of the drawing in FIGS. 3 through 6. With continued reference to FIG. 6, the housing 110 also has a stop end 117 at which a step 119 or other such stop feature prevents passage of the light bulb 105 therebeyond, the front of the light bulb 105 abutting (in some embodiments by way of an optional lens/filter 170, described below) or otherwise being prevented from emerging beyond the front of the housing 110 by this stop feature 119 at the stop end 117 of the housing 110 when the light bulb 105 is properly installed within the housing 110. In the example shown in FIGS. 3 through 6, the stop end 117 of the housing 110 corresponds to the front of the housing 110, this being the end of the housing 110 that appears toward the bottom of the drawing in FIGS. 3 through 6.

In addition, the housing 110 has a channel 118 that is formed between the free end 116 of the housing 110 and the stop end 117 of the housing 110, this channel 118 being capable of guiding the light bulb 105 along its length, the channel length direction being taken in a bidirectional sense as extending from the front of the housing 110 to the back of the housing 110. The channel width direction is a direction more or less perpendicular to the channel length direction. As can be seen at FIGS. 3 through 6, the channel 118 of the housing 110 is cylindrical, being intended for use with a light bulb 105 having a circular cross-sectional profile at the front thereof. Note, however, that the present invention is not limited to light sources having circular cross-sectional profiles.

Figure 7:
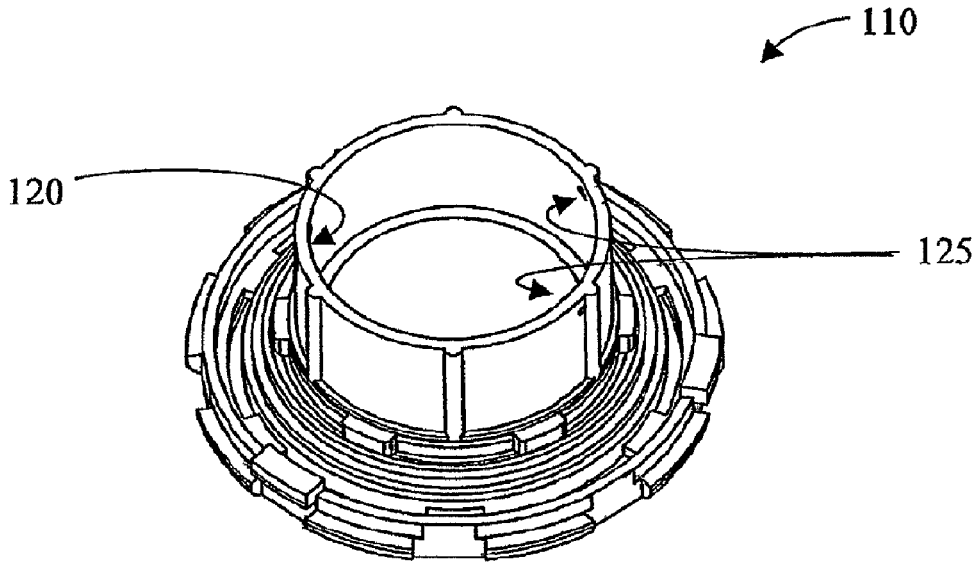
FIG. 7 is a perspective view of the housing of the lamp shown in FIGS. 3 through 5.

Referring to FIG. 7, this is a perspective view of the housing 110 of the lamp 100 shown in FIGS. 3 through 5. The view of the housing 110 in FIG. 7 is similar to the view of the housing 110 in the exploded view of FIG. 5, except that at FIG. 7 the housing 110 has been rotated slightly to better show a pair of through-holes serving as pivot supports 125, described below.

With continued reference to FIG. 7 and additional reference to the view of the housing 110 shown in FIG. 5, toward the rear (free end) of the channel 118, at mutually opposite sides more or less spanning the channel width direction, the housing 110 has features for respectively receiving a pivot end of the retainer 130 and a latch end of the retainer 130 (this pivot end and this latch end of the retainer 130 are described below). For receiving the pivot end of the retainer 130, the housing 110 has two collinear through-holes serving as pivot supports 125 that receive and support wire ends 135 serving as pivot pins for pivotable mounting of the retainer 130 to the housing 110 (these wire ends 135 serving as pivot pins of the retainer 130 are described below). For receiving the latch end of the retainer 130, the housing 110 has a slot 120 serving as a latch holder for receiving a tab 139 serving as a latch for latchable closure of the retainer 130 (this tab 139 serving as a latch of the retainer 130 is described below).

Figure 8:
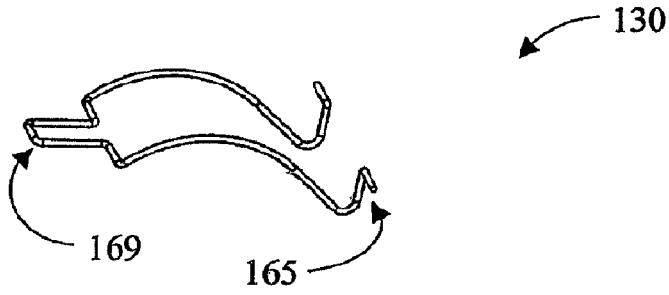
FIG. 8 is a perspective view of the retainer of the lamp shown in FIGS. 3 through 5.
Figure 9:
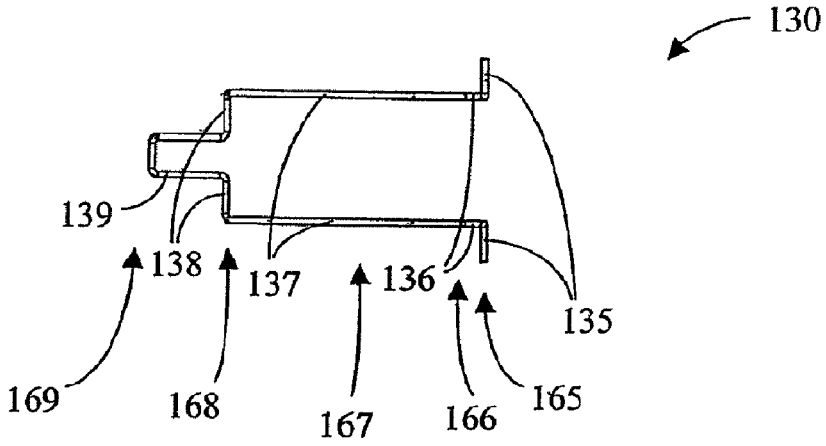
FIG. 9 is a top view of the retainer of the lamp shown in FIGS. 3 through 5.
Figure 10:
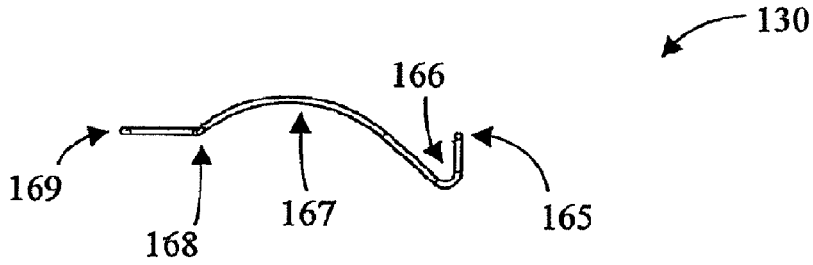
FIG. 10 is a side view of the retainer of the lamp shown in FIGS. 3 through 5.

FIGS. 8, 9, and 10 respectively show a perspective view, side view, and top view of the retainer 130.

Referring to FIGS. 8 through 10, the retainer 130 has a pivot end 165 for pivotable mounting of the retainer 130 to the housing 110, and has a latch end 169 for latchable closure of the retainer 130.

The pivot end 165 of the retainer 130 comprises two pivot pins 135, these being, in the example shown, the two ends of a single piece of wire or rod stock from which the retainer 130 has been formed. In forming the retainer 130, this single piece of wire or rod stock is bent in multiple places so as to form a partially closed loop that very roughly resembles the Greek letter omega such that either end of the wire or rod stock is splayed outward in collinear fashion. These two collinear wire ends 135 serving as pivot pins for pivotable mounting of the retainer 130 to the housing 110 are of such dimensions, orientation, and location as to mate with the two through-holes 125 in the housing 110 serving as pivot supports, described above. For example, it is preferred that the outside diameter of the wire ends 135 serving as pivot pins of the retainer 130 be slightly smaller than the inside diameter of the holes 125 in the housing 110 serving as pivot supports so that there is suitable clearance therebetween to permit pivotable motion. It is moreover preferred that the two wire ends 135 serving as pivot pins of the retainer 130 be sprung outward so as to be captured securely within the holes 125 in the housing 110 serving as pivot supports. That is, it is preferred that the retainer 130 be fashioned such that, when the retainer 130 is in its undeflected state prior to mounting of the retainer 130 on the housing 110, the distance between the wire ends 135 serving as pivot pins be greater than the distance between the holes 125 in the housing 110 serving as pivot supports. Alternatively, the wire ends 135 serving as pivot pins of the retainer 130 can be securely captured within the holes 125 in the housing 110 serving as pivot supports by, for example, providing a high-clearance region deeper within the holes 125 in the housing 110 at which the wire ends 135 of the retainer 130 are bent, stamped, upset, or are otherwise enlarged so as to prevent the wire ends 135 from slipping out of the holes 125, or any other suitable method may be employed where it is desired that the wire ends 135 serving as pivot pins of the retainer 130 be securely captured within the holes 125 in the housing 110 serving as pivot supports.

The latch end 169 of the retainer 130 comprises a tab 139 serving as a latch for latchable closure of the retainer 130. This tab 139 is of such dimensions, orientation, and location as to releasably engage with the slot 120 serving as latch holder, described above.

The retainer 130 has a curved bridge region 167 that is more or less centrally located between the latch end 169 and the pivot end 165 of the retainer 130. In the present embodiment, this curved bridge region 167 comprises two curved bridges 137. With brief additional reference to FIGS. 3 and 4, the bridge region 167 is curved such that a concave side thereof leads as the retainer 130 is moved from its open to its closed configuration. That is, in moving the retainer 130 from its open to its closed configuration, the concave side of the retainer 130 is foremost in the direction of motion, this concave side of the retainer 130 coming into contact with the convex rear surface of the light bulb 105 as the retainer 130 approaches its closed configuration.

The retainer 130 has a shoulder region 168 that is disposed between the bridge region 167 and the latch end 169 of the retainer 130. In the present embodiment, this shoulder region 168 comprises two shoulders 138. By applying finger pressure to the shoulders 138, a user can flex the retainer 130 in a manner tending to further tighten (decrease) the radii of curvature of the bridges 137, thus shortening the effective length of the retainer 130 (the length of the retainer 130 here being taken as the distance between the pivot end 165 and the latch end 169 of the retainer 130). Shortening the effective length of the retainer 130 in this fashion makes it possible for the latch end 169 of the retainer 130 to clear the back or free end 116 of the housing 110 so that the tab 139 of the retainer 130 can engage with the slot 120 of the housing 110 when the retainer 130 is being moved from its open to its closed configuration, and so that the tab 139 of the retainer 130 can be disengaged from the slot 120 of the housing 110 when the retainer 130 is being moved from its closed to its open configuration.

In moving the retainer 130 from its open to its fully closed configuration, the user might apply finger pressure to this shoulder region 168 as described above, shortening the effective length of the retainer 130 so that the latch end 169 of the retainer 130 can clear the back or free end 116 of the housing 110. By thereafter releasing finger pressure at the shoulder region 168, the user can cause the tab 139 of the retainer 130 to be inserted into the slot 120 of the housing 110. In the present embodiment, this configuration in which the tab 139 of the retainer 130 is engaged with the slot 120 of the housing 110 is referred to as the closed configuration of the retainer 130.

The retainer 130 has a heel region 166 that is disposed between the bridge region 167 and the pivot end 165 of the retainer 130. In the present embodiment, this heel region 166 comprises two heels 136. The purpose of this heel region 166 is to make it possible for the retainer 130 to swing out of the way of the channel 118 when the retainer 130 is being moved from its closed configuration to its open configuration. What is meant by swinging out of the way of the channel 118 is that the retainer 130, when in its open configuration, does not obstruct the light bulb 105 from being inserted into the free end 116 of the housing 110 and does not obstruct the light bulb 105 from being removed from the free end 116 of the housing 110.

Figure 11:
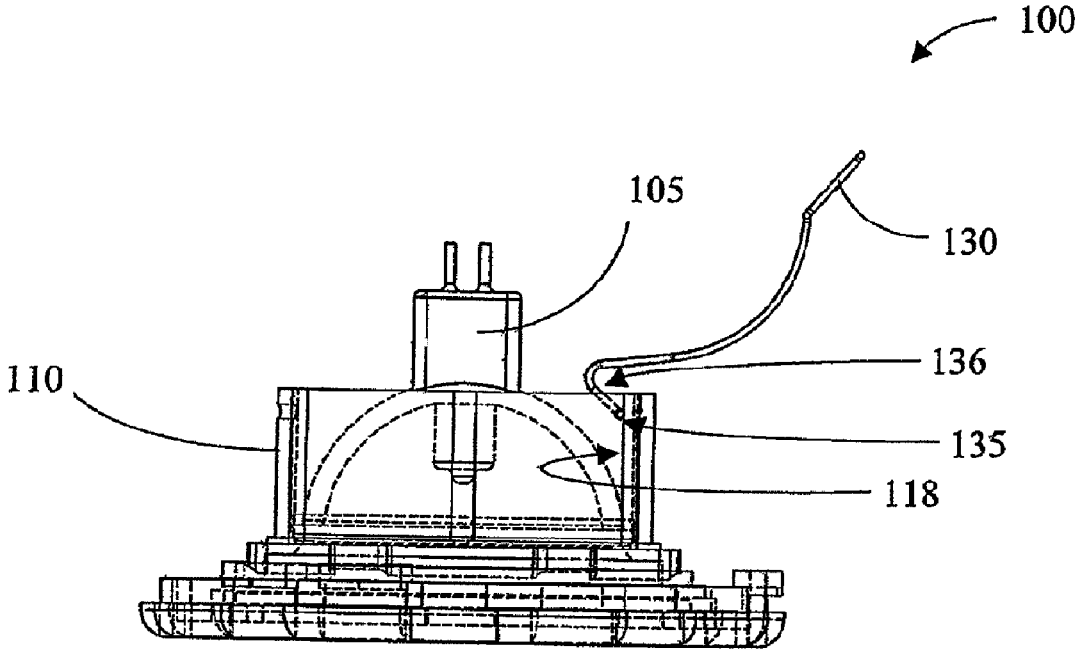
FIG. 11 is a sectional view of the lamp shown in FIGS. 3 through 5.

Referring briefly to FIG. 11, this drawing shows a sectional view of the lamp 100 of the first embodiment. At FIG. 11, the retainer 130 is shown in a configuration that is partway between its open configuration and its closed configuration. In moving the retainer 130 to its fully open configuration, the retainer 130 would be rotated further clockwise, as seen in the drawing, from the configuration shown at FIG. 11, until the heels 136 of the heel region 166 (or more specifically, that portion of the retainer 130 between the heels 136 of the heel region 166 and the pivot pins 135 of the pivot end 165) abuts the inner wall of the channel 118 of the housing 110, preventing the retainer 130 from rotating further. In the present embodiment, this configuration in which the retainer 130 has been rotated so as to swing out of the way of the channel 118 is referred to as the open configuration of the retainer 130. In the present embodiment, the retainer 130 pivots through an arc of approximately 180 degrees as it is moved from its open to its closed configuration or vice-versa.

As can be seen at FIG. 11, the retainer 130 in the present embodiment is capable of pivoting so that there is little more than the diameter of the wire or rod stock from which the retainer 130 is fashioned that would interfere with insertion of the light bulb 105 into the free end 116 of the housing 110 or removal of the light bulb 105 from the free end 116 of the housing 110. During insertion of the light bulb 105 in the housing 110 and removal of the light bulb 105 therefrom, even where clearance between the cross-sectional profile of the light bulb 105 and the inner wall of the channel 118 is tight, this small protrusion is easily avoided by, for example, slightly tipping the light bulb 105 as it is inserted or removed.

With reference again to FIGS. 8 through 10, the retainer 130 in the present embodiment is a single piece, being fashioned from a single piece of wire or rod stock. Furthermore, after the retainer 130 shown in shown in FIGS. 8 through 10 has been pivotably mounted to the housing 110 shown in FIGS. 6 and 7 by inserting the wire ends 135 serving as pivot pins of the retainer 130 into the holes 125 in the housing 110 serving as pivot supports, the retainer 130 is integral to the housing 110 inasmuch as the retainer 130 is not normally thereafter detached from the housing 110 even when replacing the light bulb 105. Furthermore, once the retainer 130 has been pivotably mounted on the housing 110, the retainer 130 can be opened or closed with one hand, finger pressure at shoulders 138 generally being sufficient to free the tab 139 of the retainer 130 from the slot 120 of the housing 110, or to insert the tab 139 of the retainer 130 into the slot 120 of the housing 110. Ability to open and close the retainer 130 with one hand without painful prying or removal of parts during bulb replacement represents a significant benefit over the conventional example shown in FIGS. 1 and 2. Moreover, the latching mechanism of the present embodiment provides positive and definitive assurance to the user that the retainer 130 is properly positioned for secure retention of the light bulb 105 within the housing assembly, thus reducing the likelihood of occurrence of poor lamp performance or light source failure due to loose or improper support of the bulb 105.

The material and dimensions of the retainer 130, and the locations of the pivot supports 125 and the slot 120 of the housing 110, are chosen so that there will be positive interference between the retainer 130 and the rear surface of the light bulb 105 when the retainer 130 is in its closed configuration. That is, the retainer 130 is designed to act as a spring so as to spring-load the light bulb 105 against the step 119 at the front or stop end 117 of the housing 110 when the retainer 130 is in its closed configuration. The pivotable mounting of the retainer 130 affords good leverage so that a substantial load can be applied to the rear surface of the light bulb 105 as the latch end 169 of the retainer 130 is manipulated into its closed configuration. Through appropriate choice of the material and dimensions of the retainer 130, it is possible to achieve a design in which the retainer 130 acts as a beam-like spring so that, as the retainer 130 is moved from its open to its closed configuration and continuing while the retainer 130 is in its closed configuration, flexure of the retainer 130 affords not only good leverage for increased bulb-retaining force (load) but also increased mechanical compliance in the bulb-retainer-housing mechanical system, meaning that any change in displacement, due for example to variation in part dimensions or installation technique or due to temperature change or impact, will produce relatively little change in bulb-retaining force.

By way of example, the retainer 130 may be fabricated from metal, thermoplastic or thermosetting resin, or any other suitable material possessing elasticity sufficient to provide spring loading of the light source. The material chosen for the retainer 130 should furthermore be able to withstand temperatures produced by the light source. Note that stainless steel may be preferred in magnetic resonance imaging (MRI) applications due to the fact that it is nonmagnetic and also has good spring characteristics. One of skill in that art will recognize that thickness and other dimensions of the retainer 130 should be chosen appropriately to balance strength with appropriate spring characteristics.

For exemplary purposes, the following is a description of a procedure for manufacturing the retainer 130. Of course, other manufacturing procedures may be used. As wire stock to be fed into a wire forming machine, 316 stainless steel may be used. Wire stock diameter may, for example, be 0.040" in diameter. This wire stock material may, for example, comply with the Restriction of Hazardous Substances Directive (i.e., RoHS). Before feeding the wire stock into the wire forming machine, the wire stock material may be precoated with an inert soap-based lubricant to allow for smooth movement of the bending mandrels during wire forming operations. To bend the wire stock into the shape of the retainer 130, a wire forming machine such as the WAF10F CNC Wire Forming Machine/Spring Coiler made by the Wafios company of Reutlingen, Germany, may be used. To facilitate wire forming operations, the wire forming machine may be programmed for numerical control such as will cause the wire stock to be formed into a shape having bends and curves of varying radii of curvature as well as straight segments of varying lengths as necessary to produce a retainer 130 as shown in FIGS. 8 through 10. This programming may be facilitated by converting shape information contained in AutoCad or other drawing files to CNC programming language for use by the wire forming machine. The wire stock may be fed through the wire forming machine using no lubrication other than the optional soap-based lubricant mentioned above. The wire forming machine may use mandrels including pivot bars and rollers to bend the wire stock based on programmed instructions as described above to produce a retainer 130 of the desired shape. For the material and process described, it should be possible to obtain a retainer 130 having the desired spring characteristics without the need for any secondary heat treatment or quenching.

Returning to description of FIG. 4 with additional reference to FIG. 6, when the retainer 130 is in its closed configuration, the concave side of the retainer 130 is directed toward the front or stop end 117 of the housing 110, the retainer 130 applying a frontward-directed load to the rear surface of the light bulb 105 as a result of contact between the concave side of the retainer 130 and the convex profile of the rear surface of the light bulb 105. What is meant here by a frontwardly directed load is that the vector sum of the forces applied from the retainer 130 to the light bulb 105 has at least a component that is directed toward the front or stop end 117 of the housing 110.

Note that in the present embodiment, when the retainer is in its closed configuration as can be seen at FIG. 4, the concave side of the retainer 130 contacts the convex rear surface of the bulb 105 at the pivot end side of the bridge region 167 but does not contact the convex rear surface of the bulb 105 at the latch end side of the bridge region 167. The reason for this is to provide clearance between the retainer 130 and the bulb rear surface at the latch end side of the bridge region 167 when the retainer 130 is in its closed configuration. It is preferred that this clearance be sufficient to prevent the latch end side of the bridge region 167 from hitting the bulb rear surface during disengagement of the latch end 169 of the retainer 130 from the latch holder 120 of the housing 110 when the retainer 130 is being moved from its closed to its open configuration. That is, without sufficient clearance between the retainer 130 and the bulb rear surface, when a user presses on the shoulders 138 of the retainer 130 in the present embodiment to flex the retainer 130 and shorten its effective length as described above, the latch end side of the bridge region 167 might hit the bulb rear surface before the tab 139 can be made to clear the free end 116 of the housing 110 during engagement of the tab 139 with the slot 120 or disengagement of the tab 139 therefrom. Note that what is meant here by the pivot end side of the bridge region 167 is all or any subset of the approximate half of the bridge region 167 that extends from the approximate center of the bridge region 167 to a point up to the heel region 166. Note that what is meant here by the latch end side of the bridge region 167 is all or any subset of the approximate half of the bridge region 167 that extends from the approximate center of the bridge region 167 to a point up to the shoulder region 168.

Although, as described above, the embodiment shown in FIG. 4 happens to be an embodiment in which the retainer 130 contacts the bulb 105 at the pivot end side the bridge region 167 but not at the latch end side thereof when the retainer is in its closed configuration, one of skill in the art will readily appreciate that a different latching mechanism would make it possible for the concave side of the bridge region 167 to contact the convex rear surface of the light bulb 105 more or less uniformly along the entirety of the bridge region 167, and such embodiments will be described in more detail below. As one example of how this more or less uniform contact between bridge region 167 and bulb 105 might be accomplished, tab and slot locations could be reversed in another embodiment so that a tab-like feature is present on the housing and a slot-like feature is present on the retainer, for example. That is, instead of flexing the retainer 130 to shorten its effective length during engagement of the tab 139 of the retainer 130 with the slot 120 of the housing 110 or disengagement of the tab 139 of the retainer 130 therefrom as in the embodiment described above, the housing and retainer in another embodiment might be such that movement of a bendable feature of the housing allows passage of a fixed-length retainer during engagement of the latch end of the retainer with the latch holder of the housing or disengagement of the latch end of the retainer therefrom. One of skill in that art will recognize that there any number of other ways in which a retainer may be made latchable to a housing without the need to alter the effective length of the retainer. Note that regardless of whether the retainer is made latchable to the housing through employment of a bendable retainer as at FIG. 4 or by other means, including the possibility of a fixed-length retainer in combination with some other suitable latching mechanism, the end of the retainer that engages with the latching mechanism shall be referred to herein as the "latch end" of the retainer, and the feature that engages with this latch end of the retainer shall be referred to herein as a "latch holder."

Returning to FIG. 10, here it can be seen that the concave side of the bridge region 167 of the retainer 130 in the embodiment shown is approximately symmetric as viewed from the side, each bridge 137 curving symmetrically in either direction from a point in the approximate center of the bridge region 167. As can be seen at FIG. 4, the axis of this symmetry is more or less aligned with the center line of the light bulb 105, and thus with the axis of the cylindrical channel 118, when the retainer 130 is in its closed configuration. That is, when the retainer 130 is in its closed configuration, an axis of symmetry of the concave side of the bridge region 167 of the retainer 130 is substantially parallel to the axis of the cylindrical channel 118. While true enough even in the embodiment shown in FIG. 4 where the retainer 130 contacts the bulb 105 at the pivot end side the bridge region 167 but not at the latch end side thereof, this is all the more true for embodiments in which the concave side of the bridge region 167 contacts the convex rear surface of the light bulb 105 more or less uniformly along the entirety of the bridge region 167 when the retainer is in its closed configuration.

Furthermore, the shape and stiffness of the retainer 130 are preferably chosen such that the concave side of the retainer 130 more or less conforms to the convex rear surface of the light bulb 105 when the retainer 130 is in its closed configuration. For embodiments such as that shown in FIG. 4 in which the retainer 130 contacts the bulb 105 at the pivot end side the bridge region 167 but not at the latch end side thereof when the retainer 130 is in its closed configuration, this means that it is preferred that the retainer 130 conform to the bulb rear surface in the vicinity of the region at which contact occurs. For embodiments in which the retainer 130 contacts the bulb 105 more or less uniformly along the entirety of the bridge region 167 when the retainer is in its closed configuration, this means that it is preferred that the retainer 130 conform to the bulb rear surface over the entirety of the bridge region 167. To the extent that the shape of the retainer 130 conforms to the shape of the light bulb 105 when the retainer 130 is in its closed configuration, the force (load) applied from the retainer 130 to the light bulb 105 when the retainer 130 is in its closed configuration can be applied over a more or less continuous locus comprising a large number of points rather than being applied discontinuously from a small number of discrete points as is the case in the conventional example shown in FIGS. 1 and 2. Furthermore, to the extent that the shape of the retainer 130 more or less conforms to the shape of the light bulb 105 when the retainer 130 is in its closed configuration, it is possible to apply a greater load to the rear surface of the light bulb 105 without causing damage to the light bulb 105 than would be the case were the load applied from a small number of discrete points. Moreover, to the extent that the shape of the retainer 130 more or less conforms to the shape of the light bulb 105 when the retainer 130 is in its closed configuration, it is possible to cause the load applied from the retainer 130 to the light bulb 105 to be distributed more or less uniformly along the concave side of the curved bridge region 167 of the retainer 130. Furthermore, to the extent that contact between the retainer 130 and the light bulb 105 occurs along an approximate arc subtending some nonzero angle, the forces applied from the retainer 130 to the rear surface of the light bulb 105 will in general have a centrally directed component, meaning a component that is directed toward the center of curvature of the concave side of the curved bridge region 137 and/or the center of curvature of the convex rear surface of the light bulb 105. In some embodiments, this centrally directed component may further assist in holding and aligning the light bulb 105 against the stop end 117 of the housing 110.

However, even in embodiments in which the shape of the retainer 130 does not conform well to the shape of the light bulb 105 when the retainer 130 is in its closed configuration, the pivotable mount and latchable closure features of the retainer 130 described above, where present, may nonetheless make it possible to cause substantial bulb-retaining force to be exerted on the light bulb 105 when the retainer 130 is in its closed configuration. For example, in an embodiment in which the retainer 130 only makes significant contact with the light bulb 105 over a relatively small fraction of the bridge region 167 when the retainer 130 is in its closed configuration, the beam-like spring action of the retainer 130 combined with the good leverage afforded by the pivotable mounting and easy closure afforded by the latch may make it possible in some embodiments for the light bulb 105 to be held more securely than would be the case with the conventional example shown in FIGS. 1 and 2. For example, even where the concave side of the retainer 130 contacts the convex rear surface of the bulb 105 at the pivot end side of the bridge region 167 but does not contact the convex rear surface of the bulb 105 at the latch end side of the bridge region 167 when the retainer is in its closed configuration as is the case with the embodiment shown at FIG. 4, the increased bulb-retaining force and convenient bulb replacement procedure made possible by the pivotable mounting and latchable closure aspects of this embodiment represent significant benefits over the conventional example shown in FIGS. 1 and 2.

Returning to FIG. 6 with additional reference to FIGS. 4 and 8, because the housing 110 supports the light bulb 105 and the retainer 130, the housing 110 must be capable of supporting the reactive mechanical loads that are produced in the housing 110 where the pivot end 165 and the latch end 169 of the retainer 130 contact the housing 110 near the free end 116 of the channel 118, and where the front of the light bulb 105 abuts the step 119 or other stop near the stop end 117 of the channel 118, when the retainer 130 is in its closed configuration. In addition to local stresses occurring near these contact points, the wall of the housing 110 must support a tension of magnitude on the order of the compressive load that is applied to the light bulb 105 by the spring action of the retainer 130 when in its closed configuration. For this reason, it is preferred that the housing 110 be molded, for example, as one solid part. As material for the housing 110, metal or any of various thermoplastic or thermosetting resins capable of withstanding temperatures generated by the light source are mentioned by way of example, but one of skill in that art will readily appreciate that a wide variety of materials may be successfully employed.

Returning to FIG. 5, the lens/filter 170, which need not be present in all embodiments, may be made of translucent or transparent glass or resin. This lens/filter 170 may be employed where optical filtering is desirable to adjust color balance or impart a desired tint to the illumination from the lamp 100, where lens action is desired to focus or spread the beam from the lamp 100, or simply for added protection to reduce the risk of damage to the light bulb 105.

Figure 12:
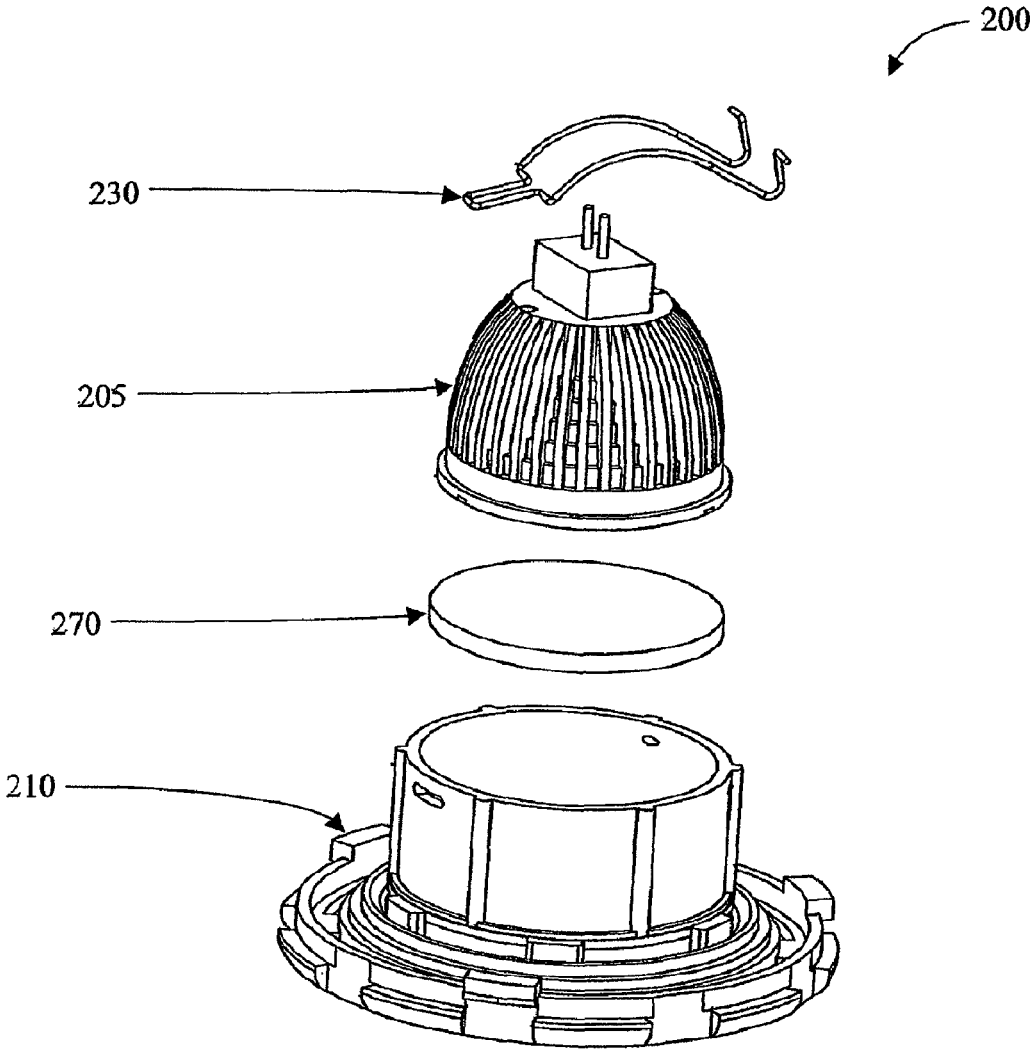
FIG. 12 is an exploded view of a lamp employing an LED light source in accordance with a second embodiment of the present invention.

Referring now to FIG. 12, this is an exploded view of a lamp 200 employing an light emitting diode (hereinafter "LED") light source in accordance with a second embodiment of the present invention. Except for changes in dimension as necessary to accommodate the LED light source 205 of the second embodiment, structure and function of the lamp 200 in accordance with the second embodiment shown in FIG. 12 is in essential respects identical to the structure and function of the lamp 100 in accordance with the first embodiment shown in FIG. 3 through 11. Like parts are therefore given like-numbered reference numerals and description thereof is omitted for brevity.

Although the first embodiment was described in terms of an example in which a halogen light bulb was employed as light source, and the second embodiment was described in terms of an example in which an LED light bulb was employed as light source, the present invention is not limited to these examples. Embodiments of the present invention may employ a halogen or other such incandescent light bulb, a fluorescent light bulb, an LED array, or any other suitable light source.

Although the curved retainer in some embodiments of the present invention will work best with light bulbs having a convex profile at the rear surface thereof, this being typical of light bulbs employing reflectors to focus or direct illumination in a frontward direction, embodiments of the present invention may also employ light sources with rear surfaces that do not necessarily have a convex profile.

In embodiments in which the shape of the rear surface of the light bulb 105 is other than dome-shaped as seen from the side as in the sectional view of FIG. 11, the shape of the bridges 137 will preferably be chosen to conform to the shape of the rear surface of the light bulb 105.

Although the present invention has been described in terms of an example in which the channel of the housing is cylindrical, being intended for use with a light bulb having a circular cross-sectional profile as viewed from the front, there is no particular objection to employment of a housing having a square, rectangular, or differently shaped cross-sectional profile for use with a light source having a correspondingly shaped cross-sectional profile. Because, in some embodiments, the channel guides the light source between a free end and a stop end of the housing, it is preferred in some embodiments that the cross-sectional profile of the channel be chosen to match the cross-sectional profile of the light source. Note that even in embodiments employing a housing that is not cylindrical for use with a light bulb that does not have a circular cross-sectional profile, it may nonetheless be preferred, in embodiments in which a retainer having a concave bridge region is employed, that the rear surface of the light bulb have a convex profile.

Furthermore, the shape of the retainer 130 shown in the drawings is merely one example of a suitable shape that may be employed when the retainer 130 is fashioned from a single piece of wire or rod stock. Even where the retainer 130 is fashioned from a single piece of wire or rod stock, one of skill in the art will recognize that there are many variations in shape that will accomplish one or more of the functions described above, these functions including pivotable mounting, latchable closure, and distributed load. Furthermore, especially where the retainer 130 is fashioned from sheet metal or resin, for example, the shape of the retainer 130 can depart significantly from the shape of the retainer 130 shown in the drawings and still accomplish one or more of these functions.

Although the present invention has been described in terms of an example in which the retainer 130 was formed from a single piece of wire or rod stock using a wire forming machine, any suitable material and manufacturing method may be used. For example, the retainer 130 may be stamped from sheet metal or may be molded or cast from high-temperature elastomer or other resin.

Above, the present invention has been described in terms of an example in which the retainer 130 is formed from a single piece of wire or rod stock, the wire or rod stock being repeatedly bent at successive locations until a partially closed shape as shown in FIGS. 8 through 10 is obtained that very roughly resembles the Greek letter omega. This partially closed shape of the retainer 130 shown in FIGS. 8 through 10 is such that the two terminations 135 of the wire or rod stock serve as discontinuous but collinear pivot pins, bending of the wire or rod stock having brought the two terminations 135 into proximity at one end, referred to as the pivot end 165, of the retainer 130. However, note that this is merely one exemplary embodiment, it being possible in some embodiments for the retainer 130 to be formed in other fashion, from other materials, and in other shapes.

Whereas the retainer 130 in the example shown in FIGS. 8 through 10 has bridges 137 in the shape of two arcs in mutually parallel or nearly parallel planes, such that as viewed from the rear of the housing 110 (similar to the view of FIG. 9) there is a more or less rectangular opening in the central region between the two arc-shaped bridges 137 of the retainer 130 to allow for emergence therethrough of the light bulb neck containing contacts for electrical connection to the light bulb 105, it is possible in some embodiments for the retainer 130 as viewed from the rear of the housing 110 to have an oval or elliptical opening and/or outline, or to have any other suitable shape, provided that, where necessary, the retainer 130 has clearance to allow for electrical connection to the light bulb 105. Where electrical connection to the light bulb 105 is made by other means, there is no particular objection to embodiments in which the two bridges 137 are replaced with a single solid bridge 137 covering, for example, approximately the entire area bounded by the bridges 137 in FIGS. 8 through 10.

Moreover, whereas the retainer 130 shown in FIGS. 8 through 10, being fashioned from wire or rod stock, is in the shape of an unfilled polygon, there is no particular objection to employment of a retainer 130 having one or more solid regions or a retainer 130 in the shape of a filled or partially filled polygon.

For example, in some embodiments, the tab 139 of the retainer 130 may be solid. That is, in some embodiments, there may be metal, resin, or other material where only empty space is shown within the outline of the partially closed loop that forms the tab 139 at the latch end 169 of the retainer 130 in the embodiment shown at FIGS. 8 through 10. Similarly, in some embodiments, the region between the bridges 137 of the retainer 130 may be filled or partially filled with metal, resin, or other suitable material, provided only that, where necessary, there is clearance for any protrusions that may extend from the rear surface of the light bulb 105, such as the neck region at the rear surface of the light bulb 105 shown in FIGS. 3 through 5 from which probes emerge for making electrical connection to the light bulb 105. Of course, in embodiments in which electrical connection is made to the light bulb 105 by other means, the region between the bridges 137 of the retainer 130 may be completely filled with metal, resin, or other suitable material.

In the case of the retainer 130 shown in FIGS. 8 through 10 which is formed from a single piece of wire or rod stock, the pivot end comprises two discrete wire ends 135 serving as pivot pins, the heel region comprises two discrete heels 136, the bridge region comprises two discrete bridges 137, and the shoulder region comprises two discrete shoulders 138. However, particularly in embodiments in which the retainer 130 is not formed from wire or rod stock but is formed instead from a solid piece of sheet metal or resin or other suitable material, with or without cutouts as necessary to avoid interference with a light bulb neck containing electrical probes or other such obstructions, any of these pairs of discrete features may be combined into a single continuous feature. For example, in some embodiments, the pivot pins 135 may merge to form a single continuous pivot region or hinge, the heels 136 may merge to form a single continuous heel region, the bridges 137 may merge to form a single continuous bridge region, and the shoulders 138 may merge to form a single continuous shoulder region. Conversely, in other embodiments, any of these pairs of discrete features may be replaced by three or more discrete features.

Although the present invention has been described in terms of an example in which the latch end 169 of the retainer 130 comprises a tab 139, the tab 139 engaging with a slot 120 serving as latch holder in the housing 110, any other suitable latching mechanism may be employed. For example, as described above, tab and slot locations can be reversed in some embodiments such that a tab-like feature is present on the housing and a slot-like feature is present on the retainer. That is, in a variation described above, the roles of housing and retainer with respect to latching might be reversed relative to that described with reference to FIGS. 3 through 12 such that it is movement of a bendable feature on the housing rather than flexing of the retainer 130 that allows passage of what may be a fixed-length retainer during engagement of the latch end of the retainer with the latch holder of the housing or disengagement of the latch end of the retainer therefrom. One of skill in that art will recognize that there any number of other ways in which the retainer may be made latchable, may be openably installed on a housing, may be releasably engaged with a latch holder, and/or may be made capable of assuming an open configuration and a closed configuration.

Furthermore, where a tab 139 and a slot 120 are employed as latching mechanism as described above with reference to FIGS. 3 through 12, although the tab 139 of the retainer 130 is shown in the drawings as being narrower than the distance between the bridges 137, the tab 139 need not be narrower than the rest of the retainer 130, it being possible to have a latch end 169 that is as wide as or even wider than the width of the retainer 130 at, say, the bridge region 167. Of course, where this is the case, the slot 120 is preferably made to have a width corresponding to the width of the tab 139 so as to permit the tab 139 to releasably engage with the slot 120.

Figure 1:
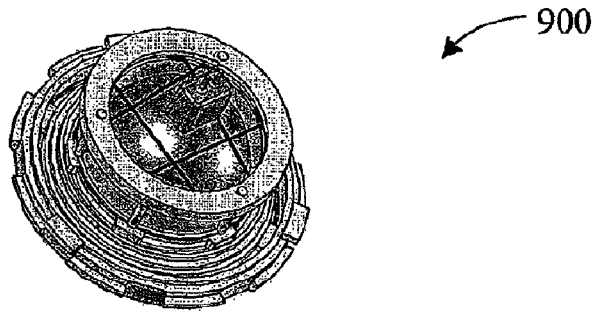
FIG. 1 Prior Art
FIG. 1 is a schematic diagram of a lamp in accordance with an example from the conventional art.
Figure 2:
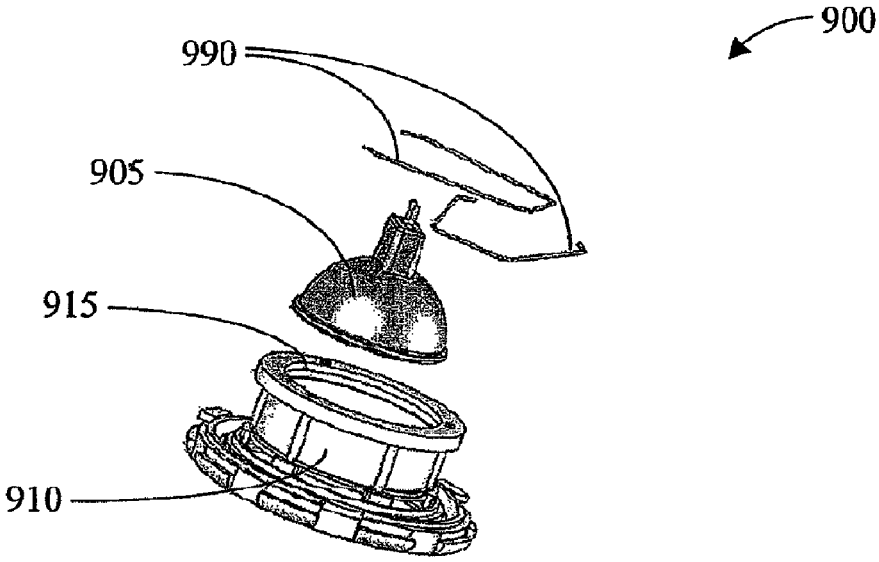
FIG. 2 Prior Art
FIG. 2 is an exploded view of the lamp shown in FIG. 1, components thereof being shown as disassembled for replacement of the light bulb.

As another example, there is no particular objection to employment of the undercut lip 915 of the conventional example shown in FIGS. 1 and 2 as latch holder to capture the tab 139 serving as latch in some embodiments of the present invention. That is, although the present invention has been described in terms of an example in which the retainer 130 is pivotably mounted to pivot supports 125 in the housing 110 and in which the retainer 130 is releasably latched to a slot 120 in the housing 110, this need not be the case. That is, in some embodiments, the pivot supports 125 and/or the slot 120 may be replaced by, for example, an undercut lip 915 as shown in the conventional example of FIGS. 1 and 2, or these may be replaced by other suitable means for securing one or both ends of the retainer 130 to the housing 110.

In such case, where a feature such as the undercut lip 915 shown in the conventional example of FIGS. 1 and 2 is used as a latch holder to capture one or more tabs 139, the pivot end 165 of the retainer 130 may be modified to resemble the V-springs 990 of the conventional example or otherwise be made to have a shape allowing insertion beneath such an undercut lip 915. That is, in some embodiments, the retainer 130 may have a curved central bridge region 167 as described above with reference to FIGS. 3 through 12, but instead of a pivot end 165 and a latch end 169, the retainer 130 may be made such that both its ends are latch ends 169, the tabs 139 at these latch ends 169 being respectively captured beneath such an undercut lip 915 of the housing 110.

Here, in embodiments in which the retainer 130 is not pivotably mounted to the housing 110, the retainer 130 should preferably be removable or should otherwise allow insertion and removal of a light bulb 105 within the housing 110 so as to permit replacement of the light bulb 105. Note that where this is the case, the term "open" as it is used with reference to the open configuration of the retainer 130 should be understood to include removal of the retainer 130 from the housing 110.

In embodiments in which the retainer 130 is pivotable, the pivot pins 135 of the retainer 130 in FIGS. 8 through 10 may be replaced by hinges or by a single continuous hinge or any other mechanism permitting the retainer 130 to be pivotably mounted to the housing 110. Moreover, although the present invention has been described in terms of an example in which the through-holes or other features serving as pivot supports 125 are mutually collinear, and the pivot pins 135 or other features serving as pivot axes are mutually collinear, this need not be the case. For example, pivot supports 125 having mutually parallel axes may be employed instead of pivot supports 125 having mutually collinear axes, and pivot pins 135 having mutually parallel axes may be employed instead of pivot pins 135 having mutually collinear axes. As another example, in embodiments employing only a single pivot support 125 to receive only a single pivot pin 135, or employing only a single hinge instead of these, the question of collinearity or parallelism of a pivot support 125 with respect to a counterpart pivot support 125, and the question of collinearity or parallelism of a pivot pin 135 with respect to a counterpart pivot pin 135, is made moot.

Although the present invention has been described in terms of an exemplary embodiment in which the retainer 130 is pivotably mounted, in which the retainer 130 is latchable, and in which the retainer 130 applies a distributed and/or frontwardly directed load to the light bulb 105, all of these aspects of the present invention are not necessarily present in all embodiments. That is, some embodiments may have a retainer 130 that is pivotably mounted but that is not latchable or does not apply a distributed and/or frontwardly directed load to the light bulb 105. As another example, some embodiments may have a retainer 130 that applies a distributed and/or frontwardly directed load to the light bulb 105 but that is not pivotably mounted or latchable.

As described above, embodiments of the present invention provide a lamp or lamp assembly as well as a method for supporting a light source. The retainer employed in the light source housing assembly of some embodiments of the present invention may open and close in easy and convenient fashion without need to remove and reinstall V-springs or other such discrete retaining components, thus facilitating light bulb replacement and making light bulb replacement more repeatable.

In some embodiments, the retaining force exerted by the retainer on the light bulb rear surface may be distributed uniformly over a more or less continuous locus of contact between retainer and light bulb rear surface.

In some embodiments, there may be improved directionality, elasticity, and/or compliance in the retaining force exerted by the retainer on the light bulb rear surface.

In some embodiments, there may be improved accuracy and/or mechanical stability in the placement of the light bulb within the housing, thus improving precision in illumination direction as well as stability of illumination direction over time.

In some embodiments, there may be reduced sensitivity to variation in bulb dimensions as well as to physical and thermal shocks that might otherwise affect placement and/or mechanical stability of the lamp within the housing.

In some embodiments, there may be improved mechanical compliance in the bulb-retaining force, meaning that there is less variation in retaining force as a function of spring displacement, permitting the retainer to deliver a more constant force to hold the bulb in place in the housing regardless of any variation in part dimensions or installation technique, temperature change, impact, vibration, or other phenomenon. As a result, this may allow wider design tolerance, and may make the lamp more tolerant of shocks, thermal expansion during heating/cooling, and other phenomena that tend to affect placement or mechanical stability of the lamp within the housing.

Furthermore, some embodiments of the present invention may provide other benefits and advantages.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A lamp comprising:

a bulb capable of providing illumination in a frontward direction and having a rear surface;

a retainer capable of applying a frontward-directed load to the rear surface of the bulb; and a housing capable of mechanically supporting the bulb and the retainer;

wherein the rear surface of the bulb has a convex profile, and the retainer has a concave side, the frontward-directed load being applied as a result of contact between the concave side of the retainer and the convex profile of the bulb rear surface.

2. A lamp assembly comprising:

a housing having a pivot support, a free end, a stop end, and a channel formed between the free end and the stop end; and a retainer having a pivot end, wherein the pivot end of the retainer is pivotably supported by the pivot support of the housing so that the retainer can assume an open and a closed configuration, wherein the retainer further has a latch end, the housing further has a latch holder, and the latch end of the retainer engages with the latch holder of the housing when the retainer is moved from its open to its closed configuration, and wherein the retainer swings out of the way of the channel of the housing when the retainer is moved from its closed to its open configuration.

3. A lamp assembly comprising:

a housing having a pivot support, a free end, a stop end, and a channel formed between the free end and the stop end; and a retainer having a pivot end, wherein the pivot end of the retainer is pivotably supported by the pivot support of the housing so that the retainer can assume an open and a closed configuration, wherein the retainer further has a latch end, the housing further has a latch holder, and the latch end of the retainer engages with the latch holder of the housing when the retainer is moved from its open to its closed configuration, and wherein the retainer further has a bridge region between the pivot end and the latch end, the bridge region being curved such that a concave side thereof leads as the retainer is moved from its open to its closed configuration.

4. A lamp assembly according to claim 3 wherein the retainer further has a shoulder region between the bridge region and the latch end, finger pressure on the shoulder region causing the retainer to flex so as to permit the latch end of the retainer to engage with the latch holder of the housing when the retainer is moved from its open to its closed configuration, and so as to permit the latch end of the retainer to disengage from the latch holder of the housing when the retainer is moved from its closed to its open configuration.

5. A lamp assembly according to claim 4 further comprising a bulb having a convex rear surface; wherein the concave side of the bridge region of the retainer contacts the convex rear surface of the bulb at the pivot end side of the bridge region, but does not contact the convex rear surface of the bulb at the latch end side of the bridge region, when the retainer is in its closed configuration.

6. A lamp assembly according to claim 5 wherein clearance between the retainer and the bulb rear surface at the latch end side of the bridge region when the retainer is in its closed configuration is sufficient to prevent the latch end side of the bridge region from hitting the bulb rear surface during disengagement of the latch end of the retainer from the latch holder of the housing when the retainer is being moved from its closed to its open configuration.

7. A lamp assembly comprising:

a housing having a pivot support, a free end, a stop end, and a channel formed between the free end and the stop end; and a retainer having a pivot end, wherein the pivot end of the retainer is pivotably supported by the pivot support of the housing so that the retainer can assume an open and a closed configuration, and, wherein the retainer has a concave side that is directed toward the stop end of the housing when the retainer is in its closed configuration.

8. A lamp assembly according to claim 7 wherein the channel of the housing is cylindrical.

9. A lamp assembly according to claim 8 wherein an axis of symmetry of the concave side of the retainer is substantially parallel to an axis of the channel when the retainer is in its closed configuration.

10. A lamp assembly comprising:

a housing having a pivot support, a free end, a stop end, and a channel formed between the free end and the stop end;

a retainer having a pivot end; and a bulb having a convex rear surface, wherein the pivot end of the retainer is pivotably supported by the pivot support of the housing so that the retainer can assume an open and a closed configuration, wherein the retainer further has a latch end, the housing further has a latch holder, and the latch end of the retainer engages with the latch holder of the housing when the retainer is moved from its open to its closed configuration, and wherein the retainer further has a curved bridge region between the pivot end and the latch end, the curved bridge region of the retainer having a concave side, the concave side of the bridge region of the retainer contacting the convex rear surface of the bulb when the retainer is in its closed configuration.

11. A lamp assembly comprising:

a housing having a pivot support, a free end, a stop end, and a channel formed between the free end and the stop end;

a retainer having a pivot end; and a bulb having a convex rear surface, wherein the pivot end of the retainer is pivotably supported by the pivot support of the housing so that the retainer can assume an open and a closed configuration, wherein the retainer further has a latch end, the housing further has a latch holder, and the latch end of the retainer engages with the latch holder of the housing when the retainer is moved from its open to its closed configuration, and wherein the retainer further has a curved bridge region between the pivot end and the latch end, the curved bridge region of the retainer having a concave side, a load applied from the retainer to the bulb rear surface when the retainer is in its closed configuration being more or less uniformly distributed along the concave side of the curved bridge region.

12. A lamp assembly comprising:

a housing having a free end, a stop end, and a channel formed between the free end and the stop end; and a retainer openably installed on the housing so as to be capable of assuming an open configuration and a closed configuration;

wherein the retainer at least partially spans a width direction of the channel when the retainer is in its closed configuration, and the retainer has a concave side that is directed toward the stop end of the housing when the retainer is in its closed configuration.

13. A lamp assembly according to claim 12 wherein an axis of symmetry of the concave side of the retainer is substantially parallel to an axis of the channel when the retainer is in its closed configuration.

14. A lamp assembly according to claim 13 wherein the channel of the housing is cylindrical.

15. A lamp assembly according to claim 12 wherein the retainer has a pivot end, the housing has a pivot support, and the pivot end of the retainer is pivotably supported by the pivot support of the housing.

16. A lamp assembly according to claim 15 wherein the retainer further has a latch end, the housing further has a latch holder, and the latch end of the retainer engages with the latch holder of the housing when the retainer is moved from its open to its closed configuration.

17. A lamp assembly according to claim 15 wherein the retainer swings out of the way of the channel of the housing when the retainer is moved from its closed to its open configuration.

18. A lamp assembly according to claim 16 wherein the latch end is a tab, and the latch holder is a slot.

19. A lamp assembly according to claim 16 wherein the retainer further has a bridge region between the pivot end and the latch end, the bridge region being curved such that a concave side thereof leads as the retainer is moved from its open to its closed configuration.

20. A lamp assembly according to claim 19 wherein the retainer further has a shoulder region between the bridge region and the latch end, finger pressure on the shoulder region causing the retainer to flex so as to permit the latch end of the retainer to engage with the latch holder of the housing when the retainer is moved from its open to its closed configuration, and so as to permit the latch end of the retainer to disengage from the latch holder of the housing when the retainer is moved from its closed to its open configuration.

21. A lamp assembly according to claim 20 further comprising a bulb; wherein the bulb can be removed from the housing when the retainer is in its open configuration; and the retainer applies a load to the bulb when the retainer is in its closed configuration.

22. A lamp assembly according to claim 21 wherein the bulb has a convex rear surface and wherein the retainer further has a curved bridge region between the pivot end and the latch end, the curved bridge region of the retainer having a concave side, the concave side of the bridge region of the retainer contacting the convex rear surface of the bulb at the pivot end side of the bridge region but not contacting the convex rear surface of the bulb at the latch end side of the bridge region when the retainer is in its closed configuration.

23. A lamp assembly according to claim 22 wherein clearance between the retainer and the bulb rear surface at the latch end side of the bridge region when the retainer is in its closed configuration is sufficient to prevent the latch end side of the bridge region from hitting the bulb rear surface during disengagement of the latch end of the retainer from the latch holder of the housing when the retainer is being moved from its closed to its open configuration.

24. A lamp assembly according to claim 16 further comprising a bulb having a convex rear surface; wherein the retainer further has a curved bridge region between the pivot end and the latch end, the curved bridge region of the retainer having a concave side, the concave side of the bridge region of the retainer contacting the convex rear surface of the bulb when the retainer is in its closed configuration.

25. A lamp assembly according to claim 16 further comprising a bulb having a convex rear surface; wherein the retainer further has a curved bridge region between the pivot end and the latch end, the curved bridge region of the retainer having a concave side, a load applied from the retainer to the bulb rear surface when the retainer is in its closed configuration being more or less uniformly distributed along the concave side of the curved bridge region.

26. A method for supporting a light source capable of providing illumination in a frontward direction and having a convex rear surface, the method comprising: guiding the light source in a channel having a free end and a stop end such that the front of the light source abuts the stop end of the channel, and such that the rear surface of the light source faces the free end of the channel; and causing a concave side of a curved retainer to contact the convex rear surface of the light source so as to apply a frontward-directed load to the light source.

* * * * *